US011839337B2

(12) United States Patent
Chen

(10) Patent No.: US 11,839,337 B2
(45) Date of Patent: Dec. 12, 2023

(54) SHOWER ROD ASSEMBLY

(71) Applicant: Jack Chen, Xiamen (CN)

(72) Inventor: Jack Chen, Xiamen (CN)

(73) Assignee: COMPONENT SOURCING INTERNATIONAL, LLC, Charlotte, NC (US)

( * ) Notice: Subject to any disclaimer, the term of this patent is extended or adjusted under 35 U.S.C. 154(b) by 37 days.

(21) Appl. No.: 17/332,200

(22) Filed: May 27, 2021

(65) Prior Publication Data

US 2022/0378254 A1 Dec. 1, 2022

(51) Int. Cl.

| | |
|---|---|
| ***A47K 3/38*** | (2006.01) |
| ***A47H 1/142*** | (2006.01) |
| ***A47H 1/02*** | (2006.01) |

(52) U.S. Cl.

CPC ..... *A47K 3/38* (2013.01); *A47H 1/02* (2013.01); *A47H 1/142* (2013.01); *A47H 2001/021* (2013.01)

(58) Field of Classification Search

CPC ..... A47K 3/38

See application file for complete search history.

(56) References Cited

U.S. PATENT DOCUMENTS

| | | | | |
|---|---|---|---|---|
| 9,044,115 | B1 * | 6/2015 | Chirigotis | A47K 3/38 |
| 2013/0198949 | A1 * | 8/2013 | Hai | A47K 3/38 29/428 |
| 2014/0131298 | A1 * | 5/2014 | Didehvar | A47H 1/022 211/105.2 |
| 2017/0332818 | A1 * | 11/2017 | Jones | A47H 1/142 |
| 2021/0378433 | A1 * | 12/2021 | Berman | A47H 1/022 |

* cited by examiner

*Primary Examiner* — Jeremy Carroll

(74) *Attorney, Agent, or Firm* — Blake E. Vande Garde; AVEK IP, LLC

(57) ABSTRACT

A shower rod assembly comprising a first arm engaged at a proximal end to a first swivel bracket assembly which includes a mounting bracket and a swivel bracket hingedly engaged to the mounting bracket, a second arm engaged to a second swivel bracket assembly which includes a mounting bracket and a swivel bracket hingedly engaged to the mounting bracket, a first attachment end engaged to a distal end of the first arm, first attachment end including a pin sleeve accessible from an outer surface, a second attachment end springingly engaged to a distal end of the second arm, the second attachment end including a coil spring mounted within a spring chamber engaged to the distal end of the second arm, and a pin emanating from an outer surface of the second attachment end where the pin springingly engages the pin sleeve to form a continuous shower rod.

16 Claims, 8 Drawing Sheets

C-C

SHOWER ROD ASSEMBLY

FIELD OF INVENTION

The present invention relates to shower curtain rods and more particularly to a shower rod assembly which is designed to enclose a shower or bathtub and swing inwardly or outwardly allowing a user to easily enter or exit the shower or bathtub.

BACKGROUND OF THE INVENTION

Traditional shower curtain rods are used at the entrance to a shower/bathtub and work in combination with a shower curtain that drape below the rod. This assembly not only provides privacy but prevents water from splashing or exiting the shower pan/bathtub area. Shower curtain rods often utilize a one-piece construction where a pair of wall-mounting bases are rigidly fastened to the walls and the rod is fixed between the opposing shower walls. This type of assembly can involve a great deal of labor in its installation since the rod must often be held into a fixed position at both of its ends while its wall-mounting base members are secured to a wall. Still other types of shower rods work to expand between the walls to frictionally hold the rod into a fixed position without mechanical attachment. These types of shower rods can easily move or fail at inopportune times while bearing the weight of a moveable shower curtain.

Accordingly, there is clearly a need for an improved shower rod assembly for allowing a user additional options in its assembly and use.

SUMMARY OF THE INVENTION

A shower rod assembly comprising a first arm engaged at a proximal end to a first swivel bracket assembly which includes a mounting bracket and a swivel bracket hingedly engaged to the mounting bracket, a second arm engaged to a second swivel bracket assembly which includes a mounting bracket and a swivel bracket hingedly engaged to the mounting bracket, a first attachment end engaged to a distal end of the first arm, first attachment end including a pin sleeve accessible from an outer surface, a second attachment end springingly engaged to a distal end of the second arm, the second attachment end including a coil spring mounted within a spring chamber engaged to the distal end of the second arm, and a pin emanating from an outer surface of the second attachment end where the pin springingly engages the pin sleeve to form a continuous shower rod.

DETAILED DESCRIPTION

Figure 1:
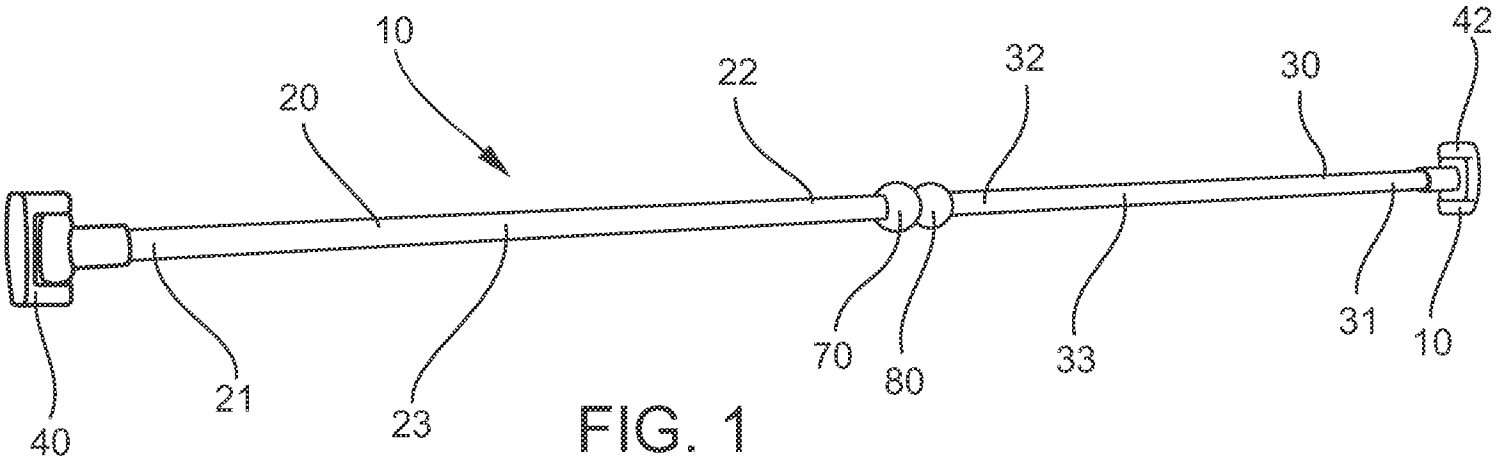
FIG. 1 is a perspective view of an embodiment of a shower rod assembly of the instant invention.
Figure 2:
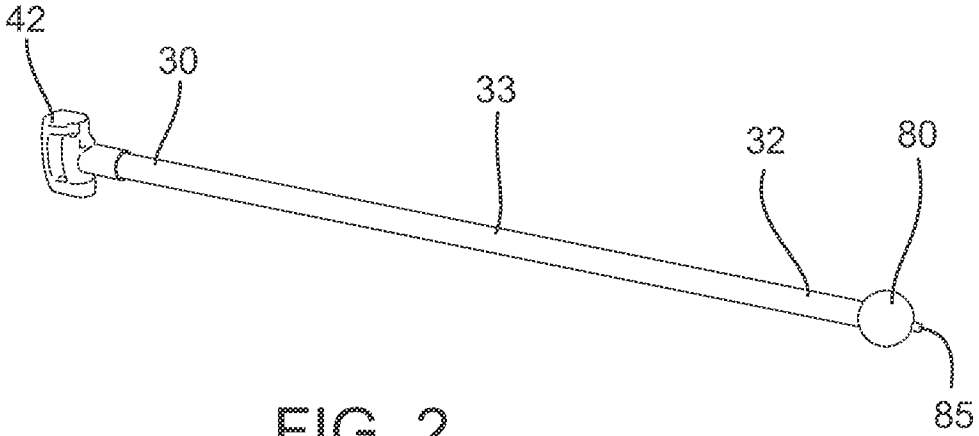
FIG. 2 is a perspective view of an embodiment of one arm of a shower rod assembly of the instant invention.
Figure 4:
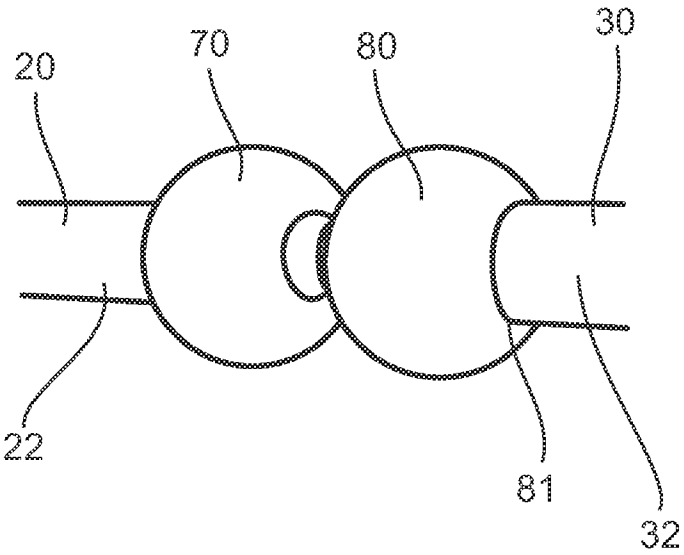
FIG. 4 is a perspective view of an embodiment of a pair of attachment ends of the instant invention.
Figure 3:
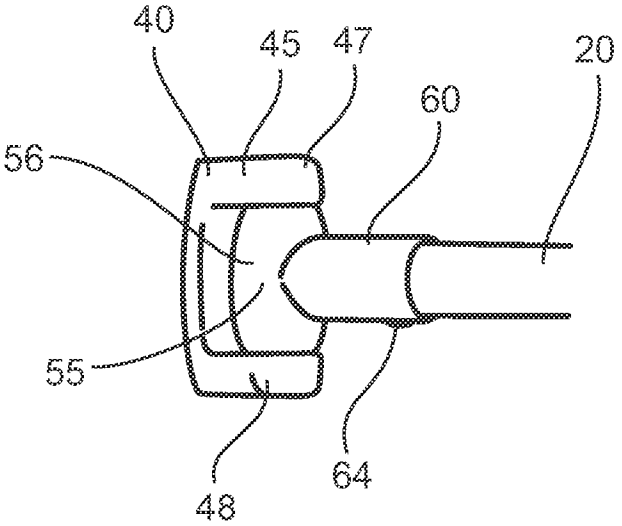
FIG. 3 is a perspective view of an embodiment of a swivel bracket assembly of the instant invention.

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The instant invention includes a shower rod assembly 10 comprising a first arm 20 is engaged at a proximal end 21 to a first swivel bracket assembly 40 which includes a mounting bracket 45 and a swivel bracket 55 hingedly engaged to the mounting bracket 45. A second arm 30 is engaged to a second swivel bracket assembly 42 which includes a mounting bracket 45 and a swivel bracket 55 hingedly engaged to the mounting bracket 45. A first attachment end 70 is engaged to a distal end 22 of the first arm 20, the first attachment end 70 includes a pin sleeve 75 accessible from an outer surface 72 of the first attachment end 70. A second attachment end 80 is springingly engaged to a distal end 32 of the second arm 30, the second attachment end 80 including a coil spring 90 mounted within a spring chamber 83 engaged to the distal end 32 of the second arm 30 and a pin 85 emanating from an outer surface 82 of the second attachment end 80 where the pin 85 of the second attachment end 70 springingly engages the pin sleeve 75 of the first attachment end 70.

Figure 5:
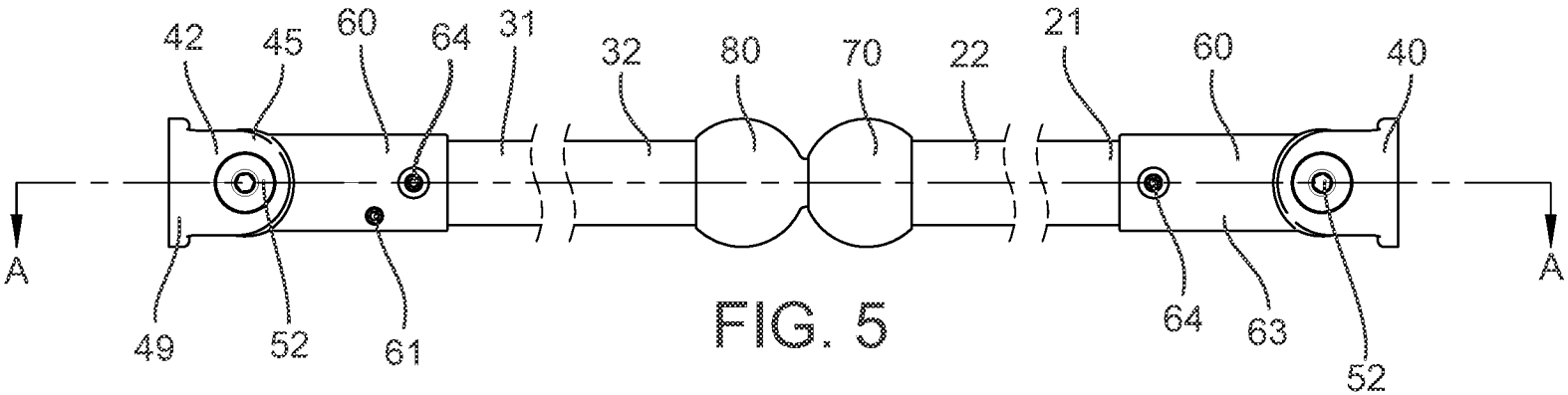
FIG. 5 is a bottom view of an embodiment of a shower rod assembly of the instant invention.
Figure 6:
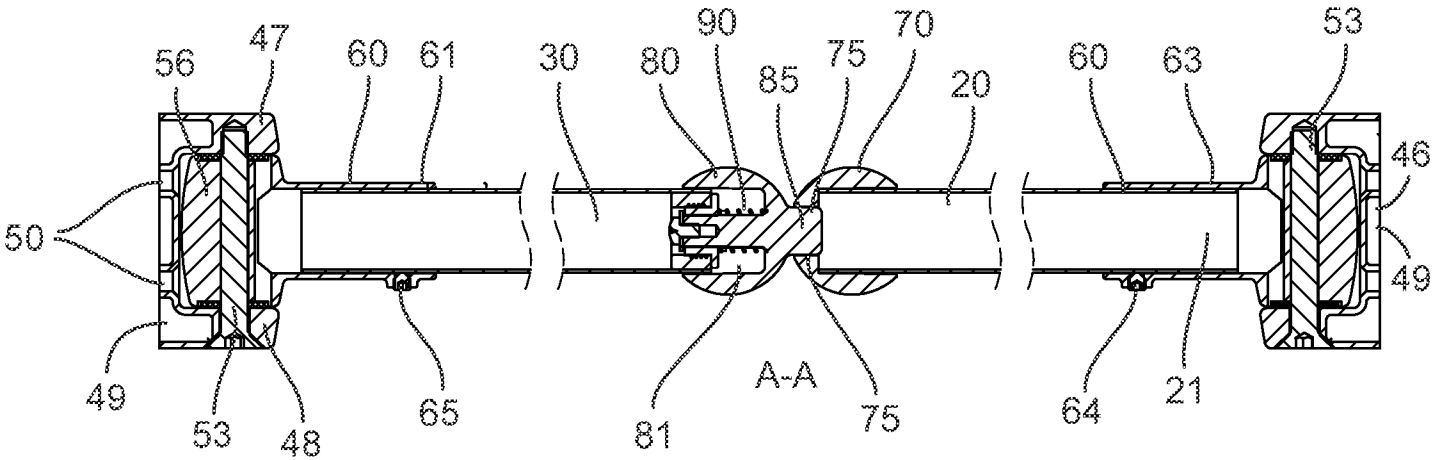
FIG. 6 is a cross-sectional view of an embodiment of a shower rod assembly of the instant invention taken along the A-A line from FIG. 5.
Figure 7:
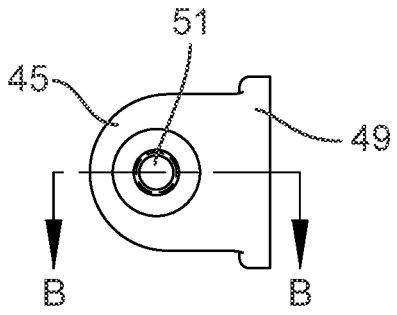
FIG. 7 is a bottom view of an embodiment of a mounting bracket of the instant invention.
Figure 8:
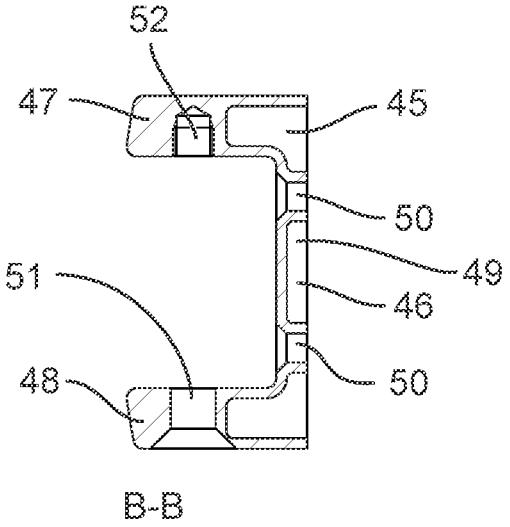
FIG. 8 is a cross-sectional view of an embodiment of a mounting bracket of the instant invention taken along the B-B line from FIG. 7.
Figure 9:
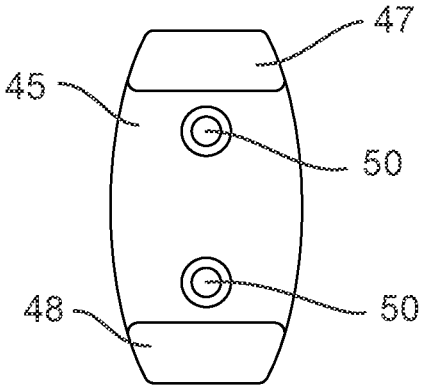
FIG. 9 is a rear view of an embodiment of a mounting bracket of the instant invention.
Figure 10:
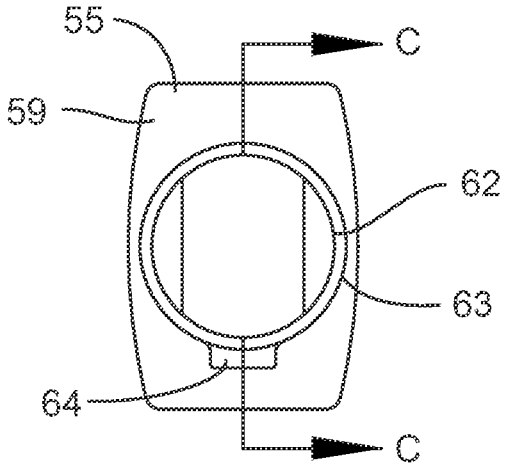
FIG. 10 is a front view of an embodiment of a swivel bracket of the instant invention.
Figure 11:
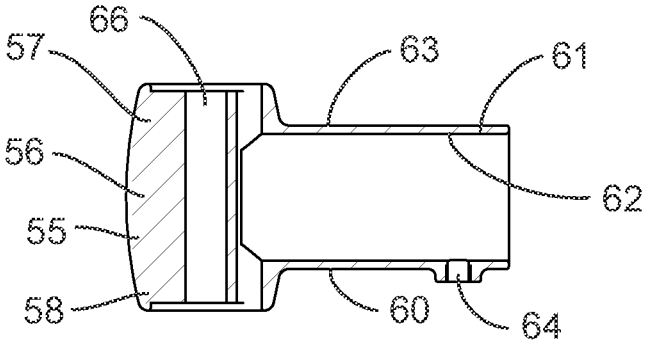
FIG. 11 is a cross-sectional view of an embodiment of a swivel bracket of the instant invention taken along the C-C line from FIG. 10.
Figure 12:
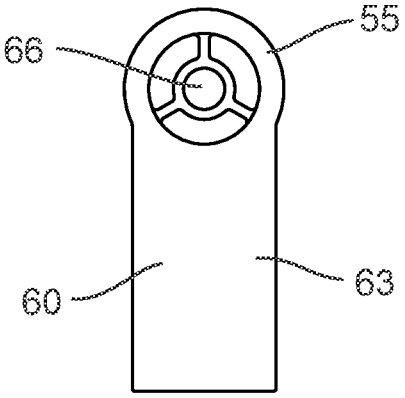
FIG. 12 is a top view of an embodiment of a swivel bracket of the instant invention.
Figure 13:
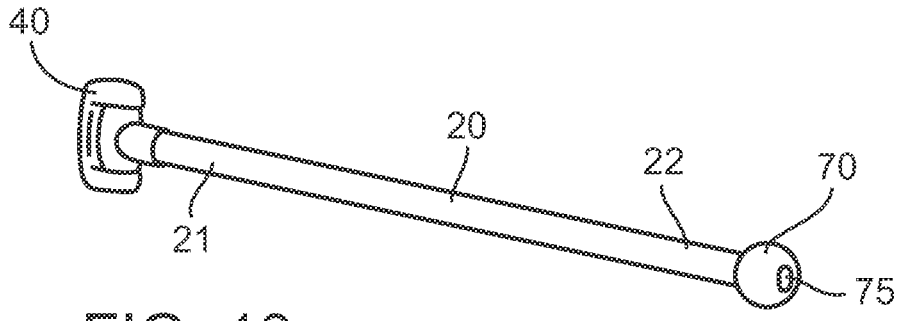
FIG. 13 is a perspective view of an embodiment of one arm of a shower rod assembly of the instant invention.
Figure 14:
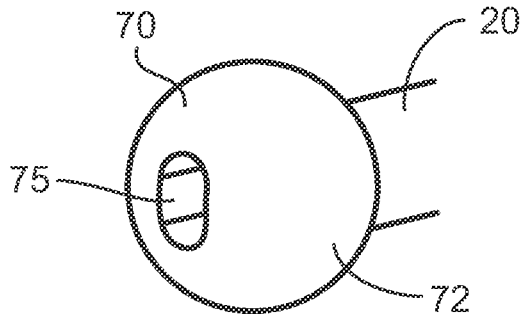
FIG. 14 is a perspective view of an embodiment of an attachment end of a shower rod assembly of the instant invention.
Figure 15:
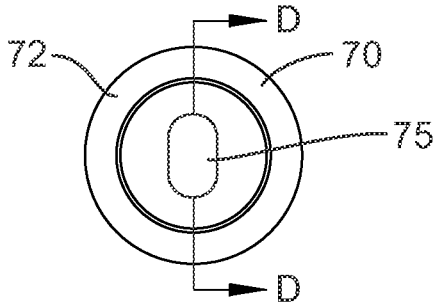
FIG. 15 is a front view of an attachment end of a shower rod assembly of the instant invention.
Figure 16:
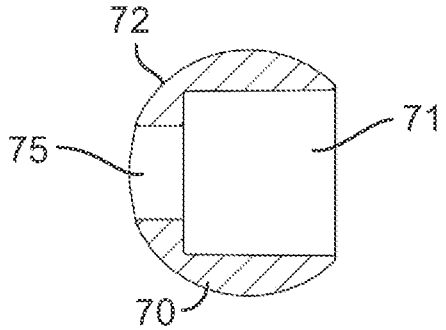
FIG. 16 is a cross-sectional view of an embodiment of an attachment end of the instant invention taken along the D-D line from FIG. 15.
Figure 17:
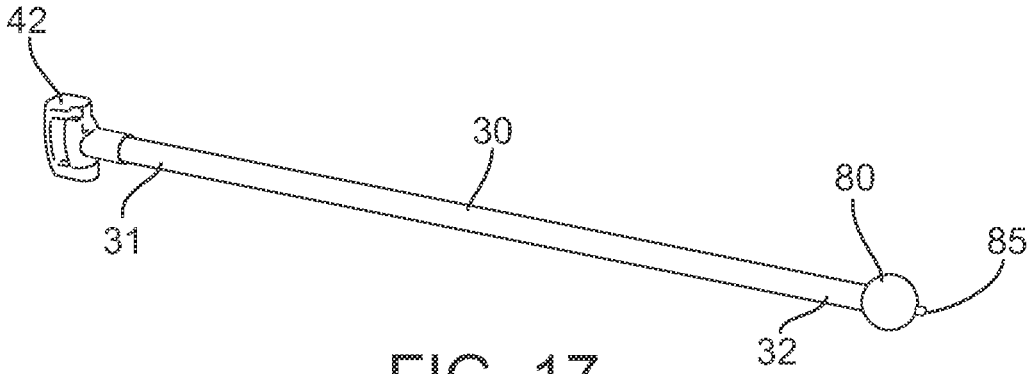
FIG. 17 is a perspective view of an embodiment of one arm of a shower rod assembly of the instant invention.
Figure 18:
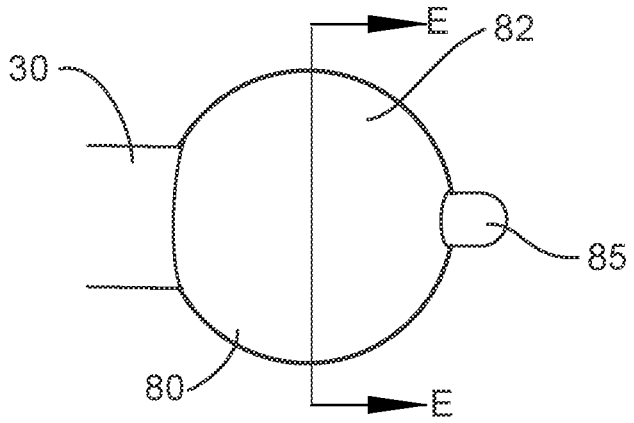
FIG. 18 is a side view of an embodiment of an attachment end of a shower rod assembly of the instant invention.

The shower rod assembly 10 generally has an overall length that is designed to be compatible with any bathtub length and shower pan. The overall length of the shower rod assembly includes the first arm 20, the second arm 30, both swivel brackets 40, 42, the first attachment end 70, and the second attachment end 80 (FIGS. 1, 5, and 6). In one embodiment, the overall length of the shower rod assembly is 152.4 cm and is designed for compatibility with a standard bathtub length. In other embodiments, the overall length of the shower rod assembly is in the range of 75-215 cm, 75-155 cm, 120-155 cm, 120-215 cm, 150-170 cm, 150-180 cm, 100-155 cm, or any combination thereof.

The first arm 20 includes a proximal end 21, a distal end 22, and a shaft 23. The second arm 30 includes a proximal end 31, a distal end 32, and a shaft 33. The first arm 20 and second arm 30 span most of the distance of the overall length of the shower rod assembly 10. The length of the first arm 20 and second arm 30 can be any to allow for the ranges for the overall length for the shower rod assembly provided above. The first arm 20 and second arm 30 can be the same length, or different lengths. The first arm 20 and second arm 30 can be straight, curved, rigid, flexible, or a combination thereof. The first arm 20 and second arm 30 can be any thickness known in the art. In one embodiment, the first arm 20 and second arm 30 have a thickness in the range of 1-5 cm, 1-4 cm, 1-3 cm, 2-5 cm, 2-4 cm, 2-3 cm, 3-4 cm, or any combination thereof. In another embodiment, the first arm 20 and second arm 30 each have a thickness of 2.5 cm. The first arm 20 and second arm 30 can be constructed of any material known in the art to be suitable for constructing a shower rod assembly including, but not limited to, metal, plastic, wood, ceramic, carbon fiber, or a combination thereof. In one embodiment of the instant invention, the reach of the first arm 20, the second arm 30, or both are adjustable.

The swivel bracket assembly 40, 42 is comprised of a mounting bracket 45 and a swivel bracket 55. FIGS. 1-3, 5-6, and 17 illustrate an embodiment of a swivel bracket assembly 40, 42. Looking first to FIGS. 5-9, there is illustrated an embodiment of a mounting bracket 45. The mounting bracket 45 includes a body 46 which forms a backplate 49 designed for engaging a wall or other surface. An upper arm 47 emanates from one end of the backplate 49 and a lower arm 48 emanates from the opposite end of the backplate, creating a horseshoe configuration. One or more mounting apertures 50 pass through the body 46 of the backplate 49 of the mounting bracket 45 which allow for fastener(s) to pass through the body and secure the mounting bracket 45 to a wall or other surface. The lower arm 48 includes an axial aperture 51 which allows an axis pin 53 to pass through the lower arm 48 and engage with a swivel bracket 55. The upper arm 47 includes an axial sleeve 52 which accepts the end of the axis pin 53 after it has passed through the axial channel 66 of the swivel bracket 55 (described below). The mounting bracket 45 can be constructed of any material known in the art to be suitable for constructing a shower rod assembly including, but not limited to, metal, plastic, wood, ceramic, carbon fiber, or a combination thereof.

FIGS. 5-6 and 10-12 illustrate an embodiment of a swivel bracket 55 which includes a body 56, an upper body 57, a lower body 58, and an exterior surface 59. A wall 60 emanates outward from the exterior surface 59 of the body 56 creating a hollow sleeve 61. The sleeve 61 includes an interior 62 and an exterior 63 and the depth of the sleeve can be any amount to permit the secure placement of an arm within the sleeve. Passing through the wall 60 of the sleeve 61 is one or more set screw apertures 64 which secures a set screw 65. An axial channel 66 is located through the body 56 of the swivel bracket 55. The axial channel 66 allows for the passage of the axis pin 53 to secure a swivel bracket 55 to a mounting bracket 45.

As illustrated in the figures, a swivel bracket assembly 40, 42 is assembled after the mounting bracket 45 is secured to a wall or other surface by passing a fastener through each mounting aperture 50. A swivel bracket 55 is then placed between the upper arm 47 and lower arm 48 of the mounting bracket 45, lining up the axial aperture 51 located in the lower arm 48, the axial channel 66 located in the body 56 of the swivel bracket 55, and the axial sleeve 52 located in the upper arm 47, to allow for the passage of an axis pin 53 through the axial aperture 51, the axial channel 66, and into the axial sleeve 52 to secure the swivel bracket 55 in place and hingedly engage the swivel bracket 55 to the mounting bracket 45.

As illustrated in the figures, a first arm 20 is engaged to a first swivel bracket assembly 40 by inserting the proximal end 21 of the first arm 20 into the sleeve 61 of the swivel bracket 55 of the first swivel bracket assembly 40. A second arm 30 is engaged to a second swivel bracket assembly 42 by inserting the proximal end 31 of the second arm 30 into the sleeve 61 of the swivel bracket 55 of the second swivel bracket assembly 42. Each arm can be secured within the sleeve by any means known in the art. As illustrated in the figures herein, a set screw 65 is used to secure the proximal end of each arm 20, 30 within each sleeve 61. The overall length of the shower rod assembly may be increased or decreased by adjusting the placement of each arm within the sleeve. The shower rod assembly is intended to allow the first arm 20 and second arm 30 to each swing in a horizontal plane either inward into the shower/bath area or outward from the shower/bath area.

Looking now to FIGS. 13-16, there is illustrated one embodiment of a first arm 20 secured to a first swivel bracket assembly 40 at its proximal end 21. A first attachment end 70 is secured to the distal end 22 of the first arm 20. The first attachment end 70 includes a rod sleeve 71 into which the distal end 22 of the first arm is inserted, and an outer surface 72. The first attachment end 70 may be secured to the first arm by any means known in the art. The first attachment end 70 also has a pin sleeve 75 accessible from the outer surface 72 of the first attachment end. The pin sleeve 75 is generally located on the opposite side of the rod sleeve 71 and is designed to engage with a pin 85 located on the second attachment end 80 (described below).

Figure 19:
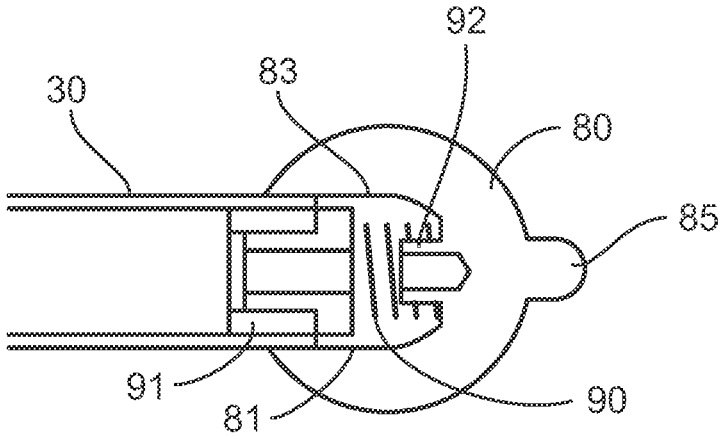
FIG. 19 is a cross-sectional view of an embodiment of an attachment end of the instant invention taken along the E-E line from FIG. 15.
Figure 20:
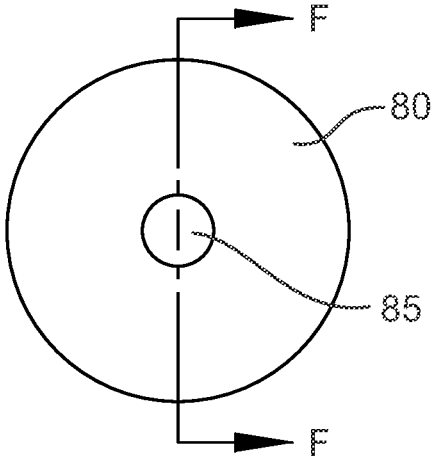
FIG. 20 is a front view of an embodiment of an attachment end of a shower rod assembly of the instant invention.
Figure 21:
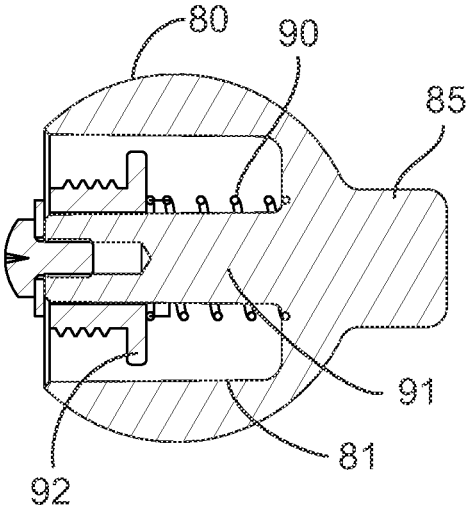
FIG. 21 is a cross-sectional view of an embodiment of an attachment end of the instant invention taken along the F-F line from FIG. 15.

Looking now to FIGS. 17-21, there is illustrated one embodiment of a second arm 30 secured to a second swivel bracket assembly 42 at its proximal end 31. A second attachment end 80 is secured to the distal end 32 of the second arm 30. The second attachment end 80 includes an rod sleeve 81 into which the distal end 32 of the second arm is inserted, and an outer surface 82. The second attachment end 80 may be secured to the second arm by any means known in the art. The second attachment end 80 also has a pin 85 emanating from the outer surface 82 of the second attachment end. The pin 85 is generally located on the opposite side of the rod sleeve 81 and is designed to engage with a pin sleeve 75 located on the first attachment end. The second attachment end 80 can further include a coil spring 90 mounted within a spring chamber engaged to the distal end 32 of the second arm. (FIGS. 19 and 21). This allows for the pin 85 of the second attachment end to springingly engage the pin sleeve 75 of the first attachment end. In another embodiment, the pin 85 is spring actuated and the second attachment end is held securely to the distal end of the second arm 30. In yet another embodiment, both the first attachment end 70 and the second attachment end 80 share the same design and are springingly engaged to the ends of the first arm 20 and second arm 30 respectively, allowing both ends to springingly engage one another when the pin 85 is inserted into the pin sleeve 75.

Figure 22A:
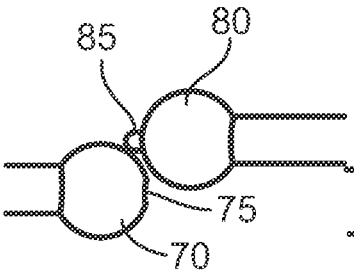
FIG. 22A is a side view of an embodiment of a pair of attachment ends of a shower rod assembly of the instant invention.
Figure 22B:
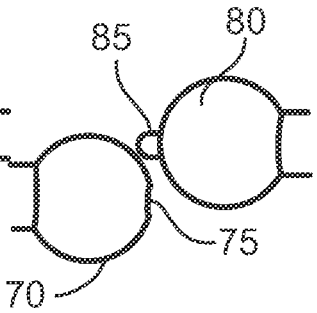
FIG. 22B is a side view of an embodiment of a pair of attachment ends of a shower rod assembly of the instant invention.
Figure 22C:
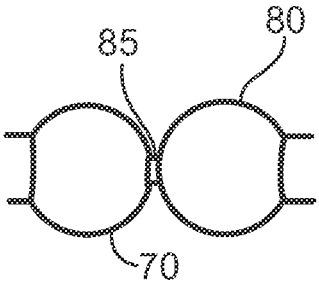
FIG. 22C is a side view of an embodiment of a pair of attachment ends of a shower rod assembly of the instant invention.
Figure 23A:
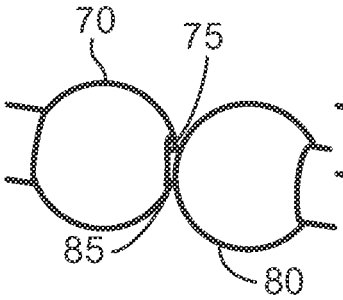
FIG. 23A is a perspective view of an embodiment of a pair of attachment ends of a shower rod assembly of the instant invention.
Figure 23B:
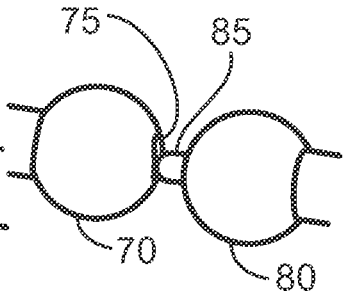
FIG. 23B is a perspective view of an embodiment of a pair of attachment ends of a shower rod assembly of the instant invention.
Figure 23C:
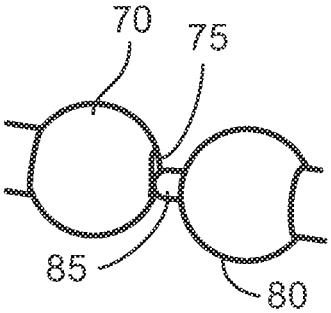
FIG. 23C is a perspective view of an embodiment of a pair of attachment ends of a shower rod assembly of the instant invention.

FIGS. 22A-C and 23A-C illustrate one embodiment of the first attachment end 70 and second attachment end 80 engaging with one another. FIGS. 22A-C illustrate the first arm 20 and second arm 30 each rotating to meet one another, with the coil spring 90 within the second attachment end being compressed to allow the pin 85 to engage with the pin sleeve 75 and the remaining spring energy then maintains the pin 85 within the pin sleeve 75 to enclose the shower/bath area. FIGS. 23A-C illustrate the second attachment end 80 being pulled back to withdraw the pin 85 from the pin sleeve 75, allowing each arm to swing freely from one another and allowing access to or from the shower bath area.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention may be embodied in other forms without departing from the spirit and the essential attributes thereof, and, accordingly, reference should be made to the appended claims, rather than to the foregoing specification, as indicating the scope of the invention. The invention illustratively disclosed herein suitably may be practiced in the absence of any element which is not specifically disclosed herein.

The invention claimed is:

1. A shower rod assembly comprising:

a first arm engaged at a proximal end to a first swivel bracket assembly;

said first swivel bracket assembly including a mounting bracket and a swivel bracket hingedly engaged to the mounting bracket;

a second arm engaged to a second swivel bracket assembly;

said second swivel bracket assembly including a mounting bracket and a swivel bracket hingedly engaged to the mounting bracket;

a first attachment end engaged to a distal end of the first arm;

said first attachment end including a pin sleeve accessible from an outer surface;

a second attachment end springingly engaged to a distal end of the second arm;

said second attachment end including a coil spring mounted within a spring chamber engaged to the distal end of the second arm; and a pin emanating from an outer surface of the second attachment end;

wherein the pin of the second attachment end springingly engages the pin sleeve of the first attachment end from the outer surface of the first attachment end toward the distal end of the first arm.

2. The shower rod assembly of claim 1 wherein the first arm and the second arm are approximately the same length.

3. The shower rod assembly of claim 1 wherein the first arm and the second arm are selected from the group consisting of: straight, curved, rigid, flexible, or a combination thereof.

4. The shower rod assembly of claim 1 wherein the reach of the first arm, the second arm, or both are adjustable.

5. The shower rod assembly of claim 1 wherein each arm swings in a horizontal plane.

6. A shower rod assembly comprising:

a first arm hingedly engaged at a proximal end to a first bracket assembly;

a second arm hingedly engaged to a second bracket assembly;

a first attachment end engaged to a distal end of the first arm;

said first attachment end including a pin sleeve accessible from an outer surface;

a second attachment end engaged to a distal end of the second arm; and said second attachment end including a pin emanating from an outer surface of the second attachment end;

the first attachment end, second attachment end, or both including a coil spring mounted within a spring chamber engaged to the distal end of each arm;

wherein the pin of the second attachment end springingly engages the pin sleeve of the first attachment end from the outer surface of the first attachment end toward the distal end of the first arm.

7. The shower rod assembly of claim 6 wherein the first arm and the second arm are approximately the same length.

8. The shower rod assembly of claim 6 wherein the first arm and the second arm are selected from the group consisting of: straight, curved, rigid, flexible, or a combination thereof.

9. The shower rod assembly of claim 6 wherein the reach of the first arm, the second arm, or both is adjustable.

10. The shower rod assembly of claim 6 wherein each arm swings in a horizontal plane.

11. The shower rod assembly of claim 6 further comprising:

the second attachment end including a coil spring mounted within a spring chamber engaged to a proximal end of the pin;

wherein the pin of the second attachment end springingly engages the pin sleeve of the second attachment end from the outer surface of the first attachment end toward the distal end of the first arm.

12. A method of installing a shower rod assembly comprising the steps of:

providing the shower rod assembly comprising:

a first arm engaged at a proximal end to a first swivel bracket assembly;

said first swivel bracket assembly including a mounting bracket and a swivel bracket hingedly engaged to the mounting bracket;

a second arm engaged to a second swivel bracket assembly;

said second swivel bracket assembly including a mounting bracket and a swivel bracket hingedly engaged to the mounting bracket;

a first attachment end engaged to a distal end of the first arm;

said first attachment end including a pin sleeve accessible from an outer surface;

a second attachment end springingly engaged to a distal end of the second arm;

said second attachment end including a coil spring mounted within a spring chamber engaged to the distal end of the second arm; and a pin emanating from an outer surface of the second attachment end;

securing the mounting bracket of the first swivel bracket to a first wall;

engaging the swivel bracket of the first swivel bracket to the mounting bracket of the first swivel bracket;

securing the mounting bracket of the second swivel bracket to a second wall;

engaging the swivel bracket of the second swivel bracket to the mounting bracket of the second swivel bracket; and engaging the pin of the second attachment end springingly with the pin sleeve of the first attachment end from the outer surface of the first attachment end toward the distal end of the first arm.

13. The method of claim 12 wherein the first arm and the second arm are approximately the same length.

14. The method of claim 12 wherein the first arm and the second arm are selected from the group consisting of: straight, curved, rigid, flexible, or a combination thereof.

15. The method of claim 12 wherein the reach of the first arm, the second arm, or both is adjustable.

16. The method of claim 12 wherein each arm swings in a horizontal plane.

* * * * *